United States Patent [19]

Gross et al.

[11] 4,456,290

[45] Jun. 26, 1984

[54] MOUNTING HARDWARE ASSEMBLY FOR GLASS DOOR CUTOUTS

[75] Inventors: Robert A. Gross; James F. Guardia, both of Yorba Linda, Calif.

[73] Assignee: Brite-Vue Glass Systems, Inc., Industry, Calif.

[21] Appl. No.: 433,270

[22] Filed: Jan. 3, 1983

[51] Int. Cl.[3] ..... E05B 9/00

[52] U.S. Cl. ..... 292/337; 292/DIG. 53; 49/503

[58] Field of Search ..... 292/336.3, 337, 91, 292/DIG. 53; 70/448–451; 49/503

[56] References Cited

U.S. PATENT DOCUMENTS

| | | | |
|---|---|---|---|
| 2,178,132 | 10/1939 | Anderson | 70/450 |
| 2,413,732 | 1/1947 | Schlage | 292/337 |
| 2,653,843 | 9/1953 | Adams et al. | 292/337 |
| 2,821,849 | 2/1958 | Schweitzer | 292/337 X |
| 2,952,150 | 9/1960 | Matzkin et al. | 292/337 X |
| 3,316,006 | 4/1967 | Russell et al. | 292/337 |
| 3,513,674 | 5/1970 | Rutherford | 70/451 |
| 3,666,309 | 5/1972 | Zarzycki | 292/337 |
| 4,096,719 | 6/1978 | Tranberg | 292/337 X |

FOREIGN PATENT DOCUMENTS

| | | | |
|---|---|---|---|
| 2903635 | 8/1980 | Fed. Rep. of Germany | 70/451 |

*Primary Examiner*—Thomas J. Holko
*Assistant Examiner*—Thomas J. Dubnicka
*Attorney, Agent, or Firm*—Boniard I. Brown

[57] ABSTRACT

An improved and simplified lock housing assembly for positioning and retaining lock or latch assemblies in cutouts in glass doors provided for that purpose which, outside of standard components such as screws, uses extrusion produced components so that the requirement for heavy machining and complex manual assembly is eliminated. The assembly includes a pair of spacers cut from the same extrusion which nest against an extruded elastomeric, channel shaped grommet about the cutout and position the lock assembly. The spacers are retained in the plane of the door by lengths of extruded plate which are fastened by screws to the opposite sides of the spacers and extend over upper and lower portions of the grommet. The screws and the grommet portion still exposed are in turn covered by extruded cover plates which include channels which slide over and dovetail with chamfered edges of the screw plates. The cover plates are, in turn, retained by the lock cylinder of the lock assembly or portions such as the handle and latch plate of the latch assembly.

15 Claims, 10 Drawing Figures

MOUNTING HARDWARE ASSEMBLY FOR GLASS DOOR CUTOUTS

BACKGROUND OF THE INVENTION

Hardware to secure mortise lock assemblies or to attach panic bar or push paddle latch assemblies or handles to cutouts in a glass door provided for that purpose, traditionally has been comprised of complex milled and machined components whose manufacture and assembly requires a sophisticated machine and assembly shop resulting in a high cost for the hardware. Therefore, there has been a need to design such hardware so that it can be produced at a greatly reduced price without reducing the security thereof.

BRIEF DESCRIPTION OF THE PRESENT INVENTION

The present assembly includes a pair of spacer members preferably cut from the same extrusion in identical widths. The spacer members have shoulders to engage the latch plate of the lock assembly on the outer edge side and facing channel fittings on the inner edge side thereof into which a longitudinal extruded spacer member is positioned. This forms a spacer assembly frame whose outer edges mate with an extruded channel shaped grommet positioned around the cutout of the glass door. The spacer assembly is thick enough side-to-side to accommodate for the thickness of the glass door plus the thickness of the sides of the grommet as it extends about opposite sides of the glass adjacent the cutout. Screw plates are then fastened to the opposite sides of the spacer assembly by suitable flush fasteners. The screw plates normally extend over both sides of the upper and lower portions of the grommet. These members preferably are sawn from an extrustion identical to the one from which the longitudinal spacer member was cut. The screw plates have chamfered outer edges with ribs formed thereon. Extruded cover plates each having a dovetail channel are then slid over the screw plates and the previously exposed central portions of the grommet to further retain the spacer members in the cutout of the glass door by friction through the grommet. The lock cylinders, latch components or handles are then installed in aligned holes in the cover and screw plates which thereafter prevent relative sliding movement therebetween.

Therefore, beside a few standard screws, all of the components needed to secure lock or latch assemblies or handles to glass doors are constructed from extruded pieces whose length or width, depending upon the part, is merely sawn off to the proper size with very little machining needed thereafter. This results in a low cost assembly, which due to its design, is adaptable to various sizes and types of locks, latches, and handles. Installation is also economical because the extrusions are formed to make installation a simple operation, it only requiring a minimum of hand tools.

It is therefore an object of the present invention to provide hardware constructed primarily from extrusions for retaining, locks, latches, pushbars and the like, in glass doors having one or more cutouts for that purpose.

Another object is to provide hardware for retaining a mortise type lock assembly in a glass door at a greatly reduced cost.

Another object is to provide lock assembly retaining hardware which can be easily installed by unskilled workers.

These and other objects and advantages of the present invention will become apparent to those skilled in the art after considering the following detailed specification in conjunction with the accompanying drawings wherein:

DETAILED DESCRIPTION OF THE SHOWN EMBODIMENTS

Figure 1:
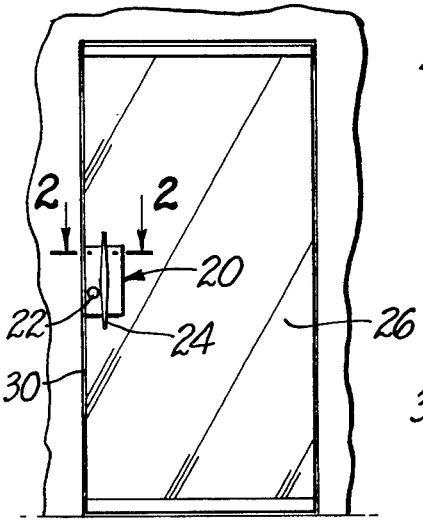
FIG. 1 is an elevational view of a glass door with a lock assembly and handle retained thereto by the present invention.
Figure 2:
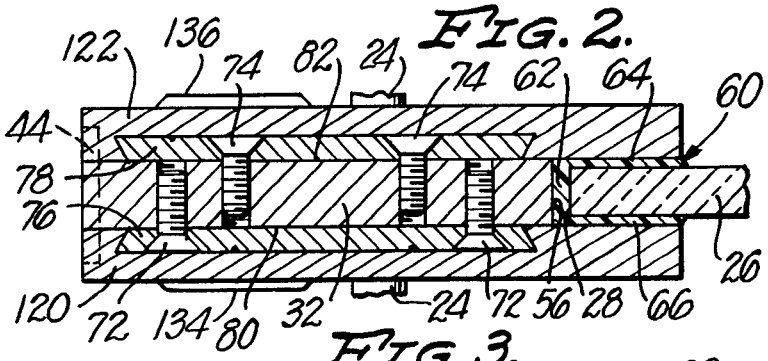
FIG. 2 is an enlarged cross-sectional view taken on line 2—2 of FIG. 1.
Figure 3:
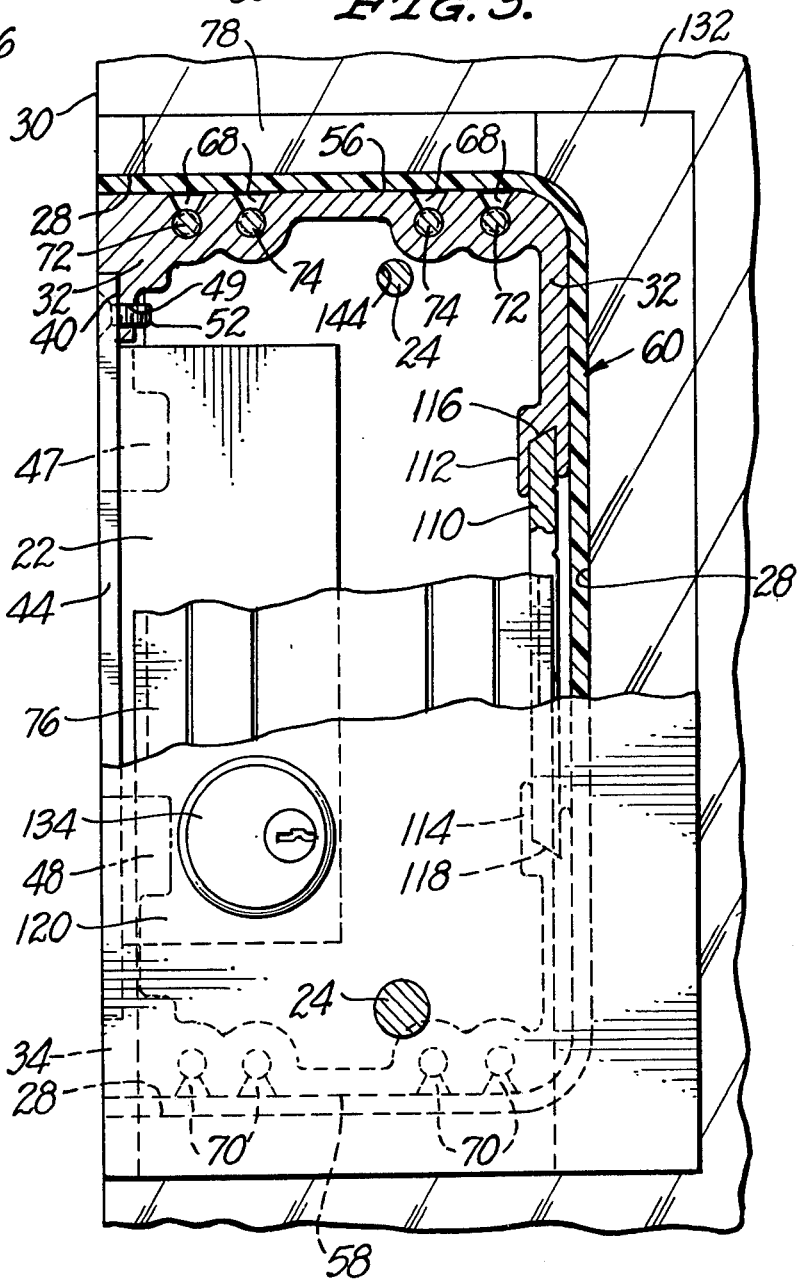
FIG. 3 is a partial cross-sectional side view of the assembly of FIG. 2.
Figure 4:
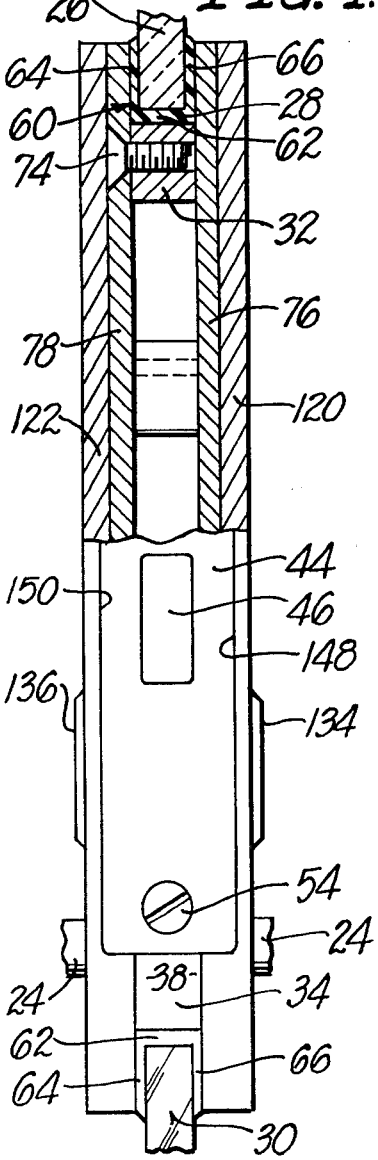
FIG. 4 is an edge view of FIG. 3 partially in cross-section.

Referring to the drawings more particularly by reference numbers, number 20 in FIG. 1 refers to a mounting hardware assembly for retaining a mortise lock 22 and handle 24 to a glass door 26. As shown in FIGS. 2, 3 and 4, such glass doors 26 include a cutout 28 at a mid position in their outer edge 30 for installation of the mortise lock 22. Heretofore the retention of the mortise lock 22 has required numerous expensive machined parts which are difficult to manufacture and assemble. However, the present assembly 20 is constructed from three metallic extrusions and an elastomeric extrusion.

Figure 5:
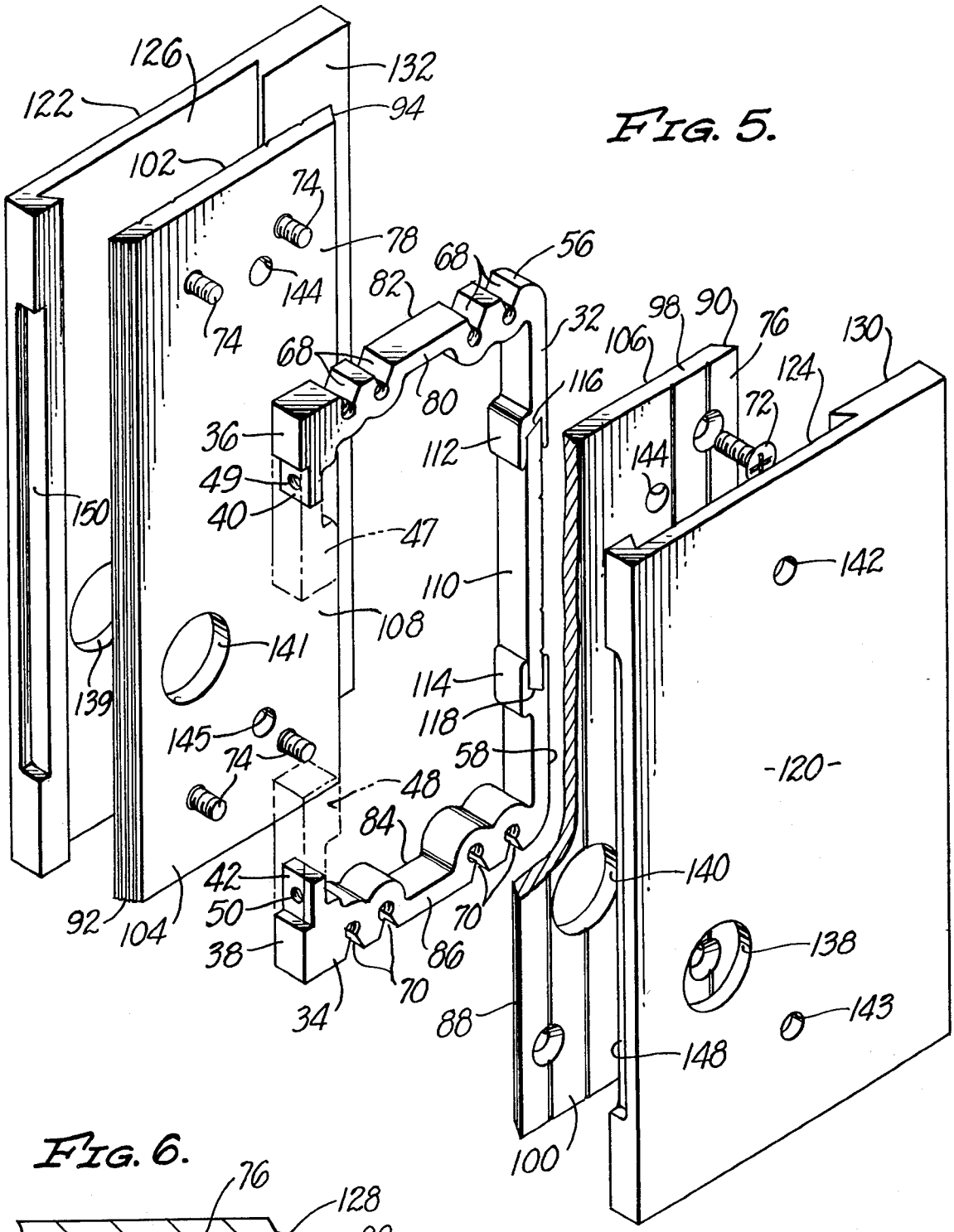
FIG. 5 is an exploded view of the version of the present invention shown in FIGS. 1 through 4.
Figure 6:
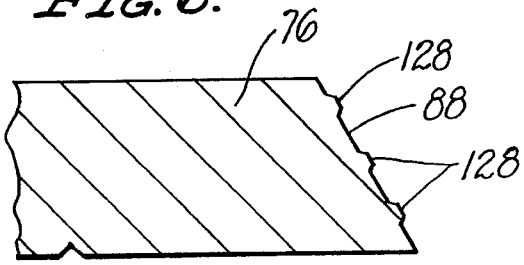
FIG. 6 is an enlarged, detail view of the edge of one of the screw plates of FIG. 5.

The mortise lock assembly 22 is retained in proper position with respect to the edge 30 of the door 26 by a pair of spacer members 32 and 34 which, as can be seen more clearly in FIG. 5, are pieces cut off the same extrusion. The members 32 and 34 include outer edges 36 and 38 respectively, which with surfaces 40 and 42, formed by small milling cuts, provide a back supporting surface for the latch plate 44 through which the latch bolt 46 of the mortise lock 22 extends. Portions 47 and 48 adjacent the surfaces 40 and 42 of the original extrusion shape are cut off to provide space for the lock 22. If a large quantity of the latch plates 44 are of a standard size and are to be centrally located, then the spacer members 32 and 34 can have the surfaces 40 and 42, and the cut off portions 47 and 48 formed by the extrusion die which forms the other edges thereof. Threaded holes 49 and 50 are provided through the surfaces 40 and 42 so that the latch plate 44 can be retained thereto by means of fasteners 52 and 54.

The outer peripheral edges 56 and 58 of the spacer members 32 and 34 nest against a channel-shaped grommet 60 whose center 62 is positioned between the peripheral edges 56 and 58 and the cutout 28. The sides 64 and 66 of the grommet 60 extend over the glass door 26 adjacent the cutout 28 for frictional engagement therewith.

The edges 56 and 58 of the spacer members 32 and 34 include a plurality of transverse notches 68 and 70 which are threaded to receive flush fasteners 72 and 74 which extend through and connect the screw plates 76 and 78 to the opposite side surfaces 80 and 82, and 84 and 86 of the spacer members 32 and 34 respectively. The screw plates 76 and 78 are constructed from a relatively flat extrusion having chamfered longitudinal edges 88 and 90, and 92 and 94 respectively, and whose upper and lower portions 98 and 100, and 102 and 104 extend beyond the spacer members 32 and 34 to make tight frictional contact on their inner surfaces 106 and 108 with portions of the sides 64 and 66 of the channel-shaped grommets 60 when tightened by the fasteners 72 and 74. The screwplates 76 and 78 retain the spacer members 32 and 34 and their connected mortise lock 22 in the plane of the door 26. The same extrusion that is used to form the screw plates 76 and 78, is also used to make a longitudinal spacer 110 which extends between channels 112 and 114 formed in the innermost edges of the spacer members 32 and 34, the channels 112 and 114 being shaped to mate with the chamfered edges 116 and 118 thereof.

Once the spacer members 32 and 34, the longitudinal spacer 110 and the screw plates 76 and 78 have been installed on the door 26, outer slide covers 120 and 122, having dovetail channels 124 and 126 respectively, are slid over the screw plates 76 and 78 to prevent access to the fasteners 72 and 74. The edges 88 and 90, and 92 and 94 of the screw plates 76 and 78 include ribs 128 which accommodate the sliding between the edges 88, 90, 92 and 94 and the dovetail channels 124 and 126 by deforming slightly. The dovetail channels 124 and 126 are offset on the covers 120 and 122 so that back abutment surfaces 130 and 132 are formed on the covers 120 and 122 respectively. These contact and cover the otherwise uncovered portions of the sides 64 and 66 of the channel-shaped grommet 60 and also help maintain the assembly 20 to the door 26 and distribute any load that might be applied thereto by means of the handle 24 or the latch bolt 46. The outer slide covers 120 and 122 are cut from the same extrusion so that only three extrusions are required for the seven main metallic components of the assembly 20, the spacer members 32 and 34, the screw plates 76 and 78, the longitudinal spacer 110 and the outer slide covers 120 and 122.

The lock cylinders 134 and 136 are thereafter installed in the mortise lock through holes 138 and 139 in the outer slide covers 120 and 122 and aligned holes 140 and 141 in the screw plates 76 and 78. The outer slide covers 120 and 122 are also locked against sliding movement by the handle 24, a portion of which passes through holes 142 and 143 in the slide covers 120 and 122 and holes 144 and 145 in the screw plates 76 and 78, and the fastening of the latch plate 44 which extends into longitudinal cutouts 148 and 150 in the slide covers 120 and 122 and whose attaching fasteners 52 and 54 are not accessible when the door 26 is closed.

Figure 7:
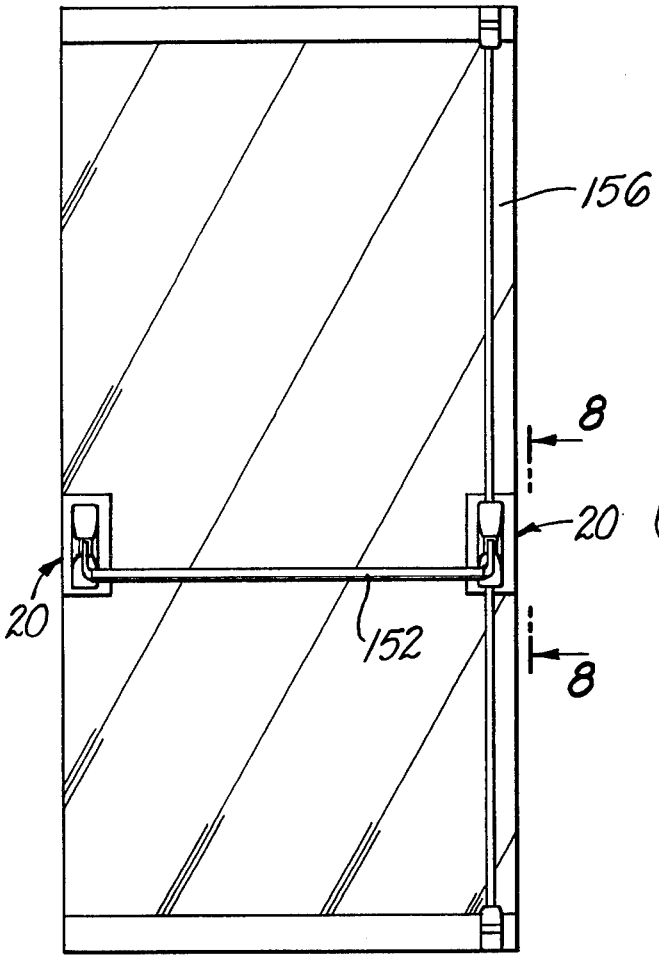
FIG. 7 is an elevational view of a glass door having a pair of panic bar supports mounted by means of a modified version of the present invention.
Figure 8:
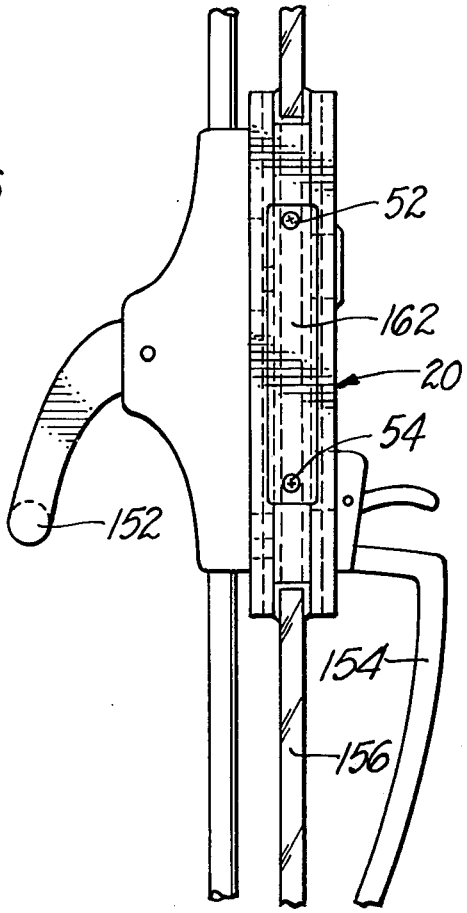
FIG. 8 is an edge view taken on line 8—8 of FIG. 7.
Figure 9:
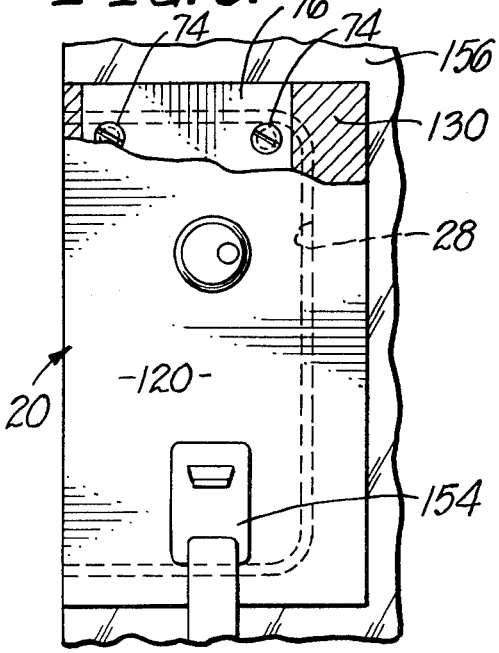
FIG. 9 is a partial cross-sectional elevational view of the latch handle side of the arrangement of FIGS. 7 and 8.
Figure 10:
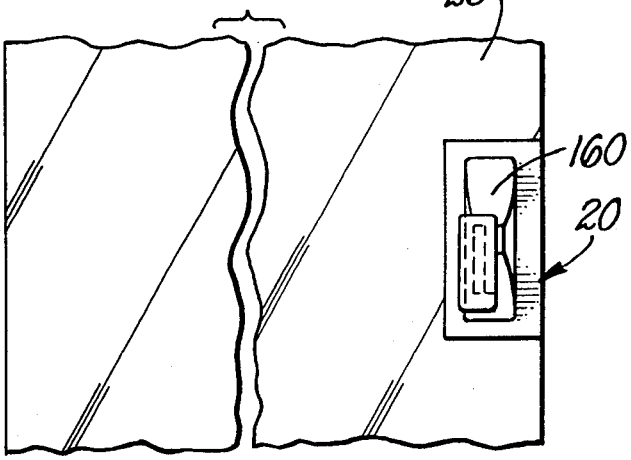
FIG. 10 is a partial elevational view of a glass door having a push paddle latch retained thereto using the present invention.

Although the foregoing description has assumed that a mortise lock is being retained in the glass cutout 28 of the door 26, the assembly 20 with suitable holes therethrough for the fastening of standard hardware can be used to retain a panic bar 152 and latch handle 154 to the opposite sides of a glass door 156, as shown in FIGS. 7, 8 and 9, or to retain a single push paddle latch 160 to the door 26 as shown in FIG. 10. In the case of the panic bar 152 wherein the latches are provided at the top and bottom of the door, a blank latch plate 162 is fitted in the cutouts 148 and 150 on the surfaces 40 and 42 for retention by the fasteners 52 and 54. Therefore, the same basic extrusions can be used to manufacture parts for all types of door latches without major machining modifications.

Therefore, there has been shown and described novel lock housing assembly hardware which fulfills all of the objects and advantages sought therefor. Many changes, modifications, variations and other uses and applications of the subject invention will however become apparent to those skilled in the art after considering the foregoing specification together with the accompanying drawings and claims. All such changes, modifications, variations and other uses and applications which do not depart from the spirit and scope of the invention are deemed to be covered by the invention which is limited only by the claims which follow.

What is claimed is:

1. An assembly to retain hardware including a latch plate to a glass door defining at least one generally rectangular cutout for that purpose between first and second facing edges connected by a third edge therebetween, said assembly including:

spacer member means configurated for positioning in the defined cutout adjacent the first cutout edge, the second cutout edge and at least a portion of the third cutout edge, said spacer means having:

respective edge surfaces for facing the first, second and third cutout edges, respectively, first and second side surfaces; and at least one latch plate surface facing opposite said second edge thereof on which the latch plate can be retained;

a first fastener plate positioned to abut said first side surfaces of said spacer member means and extend over portions of the door adjacent the first and second cutout edges thereof, said first fastener plate having:

first and second edges; and means for fastening to said spacer member means;

a second fastener plate positioned to abut said second side surfaces of said spacer member means and extend over portions of the door adjacent the first and second cutout edges thereof, said second fastener plate having:

first and second edges; and means for fastening to said spacer member means;

a first cover plate positioned facing said first side surfaces of said spacer member means and extending over portions of the door adjacent the first, second and third cutout edges thereof, said first cover plate having:

a channel with sides shaped to engage said first and second edges of said first fastener plate; and a second cover plate positioned facing said second side surfaces of said spacer member means and extending over portions of the door adjacent the first, second and third cutout edges thereof, said second cover plate having:

a channel with sides shaped to engage said second and second edges of said first fastener plate.

2. An assembly to retain hardware including a latch plate to a glass door defining at least one generally rectangular cutout for that purpose between first and second facing edges connected by a third edge therebetween, said assembly including:

a first spacer member shaped for positioning in the defined cutout adjacent the first cutout edge and at least a portion of the third cutout edge, said first spacer member having:

a first edge surface for facing the first cutout edge;

a second edge surface for facing the third cutout edge;

first and second side surfaces; and a latch plate surface facing opposite said second edge thereof on which the latch plate can be retained;

a second spacer member shaped for positioning in the defined cutout adjacent the second cutout edge and at least a portion of the third cutout edge, said second spacer member having:

a first edge surface for facing the second cutout edge;

a second edge surface for facing the third cutout edge;

first and second side surfaces; and a latch plate surface facing opposite said second edge thereof on which the latch plate can be retained;

a first fastener plate positioned to abut said first side surfaces of said first and second spacer members and extend over portions of the door adjacent the first and second cutout edges thereof, said first fastener plate having:

first and second edges; and means for fastening to said first and second spacer members;

a second fastener plate positioned to abut said second side surfaces of said first and second spacer members and extend over portions of the door adjacent the first and second cutout edges thereof, said second fastener plate having:

first and second edges; and means for fastening to said first and second spacer members;

a first cover plate positioned facing said first side surfaces of said first and second spacer members and extending over portions of the door adjacent the first, second and third cutout edges thereof, said first cover plate having:

a channel with sides shaped to engage said first and second edges of said first fastener plate; and a second cover plate positioned facing said second side surfaces of said first and second spacer members and extending over portions of the door adjacent the first, second and third cutout edges thereof, said second cover plate having:

a channel with sides shaped to engage said first and second edges of said second fastener plate.

3. The assembly as defined in claim 1 wherein said channels of said first and second cover plates are dovetail channels and wherein said first and second side surfaces of said first and second fastener plates are chamfered to slide in and engage said dovetail channels.

4. The assembly as defined in claim 2 wherein said channels of said first and second cover plates are dovetail channels and wherein said first and second side surfaces of said first and second fastener plates are chamfered to slide in and engage said dovetail channels.

5. The assembly as defined in claim 3 wherein said first and second edges of said first and second fastener plates include ribs therealong for sliding engagement with said dovetail channels.

6. The assembly as defined in claim 2 wherein said first spacer member further includes:

a channel formed facing away from said first edge surface thereof, wherein said second spacer member further includes:

a channel formed facing away from said first edge surface thereof and toward said channel of said first spacer member, and wherein said assembly further includes:

a third spacer member positioned between said first and second spacer members adjacent the third edge of the cutout and extending into said channels of said first and second spacer members.

7. The assembly according to claim 1, wherein:

the spacer member means, the first and second fastener plates and the first and second cover plates are fabricated by extrusion, said fastener plates having the same cross-sectional extrusion shape, and said cover plates having the same cross-sectional extrusion shape.

8. The assembly as defined in claim 6 wherein said first and second spacer members have the same extrusion shape, said first and second fastener plates and said third spacer member have the same extrusion shape, and said first and second cover plates have the same extrusion shape.

9. The assembly as defined in claim 8 wherein said first and second cover plates each include:

first and second edges generally aligned with said channels thereof, said first edges of said first and second cover plates being positioned adjacent said latch plate surfaces of said first and second spacer members and each including:

a rectangular latch plate cutout therein which extends from adjacent said latch plate surface of said first spacer member to adjacent said latch plate surface of said second spacer member.

10. The assembly as defined in claim 1 wherein said first and second cover plates each include:

an aligned lock cylinder retention surface defining a hole therethrough, and wherein said first and second fastener plates each include:

a lock cylinder retention surface defining a hole therethrough in alignment with said aligned lock cylinder retension surfaces of said first and second cover plates, whereby the insertion of a lock cylinder therethrough prevents relative sliding of said first and second cover plates and said first and second fastener plates.

11. The assembly as defined in claim 2 wherein said first and second cover plates each include:

an aligned lock cylinder retention surface defining a hole therethrough, and wherein said first and second fastener plates each include:

a lock cylinder retention surface defining a hole therethrough in alignment with said aligned lock cylinder retension surfaces of said first and second cover plates, whereby the insertion of a lock cylinder therethrough prevents relative sliding of said first and second cover plates and said first and second fastener plates.

12. The assembly as defined in claim 2 wherein said means for fastening said first and second spacer members to said first fastener plate include:

a plurality of fasteners positioned therethrough, wherein said means for fastening said first and second spacer members to said second fastener plate include:

a plurality of fasteners positioned therethrough, and wherein said first and second spacer members each include:

a plurality of notches in said first edge surfaces of said first and second spacer members threaded to engage said fasteners of said first and second fastener plates.

13. The assembly as defined in claim 2 further including:

a channel grommet shaped for positioning between said first and second edge surfaces of said first and second spacer members and the first, second and third edges of the cutout, said channel grommet having:

a central portion in contact with said first and second edge surfaces of said first and second spacer members;

a first side portion in contact with said first fastener plate and said first cover plate for squeezing against the glass door for frictional engagement therewith; and a second side portion in contact with said second fastener plate and said second cover plate for squeezing against the glass door for frictional engagement therewith.

14. The assembly as defined in claim 2 wherein portions of said first and second spacer members adjacent said first and second edges thereof have the same cross-sectional shape.

15. The assembly as defined in claim 2 wherein said third spacer member and said first and second fastener plates have the same cross-sectional shape.

* * * * *